United States Patent [19]

Waterman et al.

[11] Patent Number: 5,073,761

[45] Date of Patent: Dec. 17, 1991

[54] NON-CONTACTING RADIO FREQUENCY COUPLER CONNECTOR

[75] Inventors: Timothy G. Waterman, Eldersburg; Jimmy W. Mullis, Catonsville; John H. Staehlin, Lutherville, all of Md.

[73] Assignee: Westinghouse Electric Corp., Pittsburgh, Pa.

[21] Appl. No.: 533,477

[22] Filed: Jun. 5, 1990

[51] Int. Cl.[5] ..... H01P 1/04

[52] U.S. Cl. ..... 333/24 C; 333/246; 333/260

[58] Field of Search ..... 333/24 C, 246, 260, 333/261

[56] References Cited

U.S. PATENT DOCUMENTS

| | | | |
|---|---|---|---|
| 3,113,277 | 12/1963 | Casper et al. . | |
| 3,309,632 | 3/1967 | Trudeau | 333/260 X |
| 3,621,478 | 11/1971 | Johnson . | |
| 3,629,733 | 12/1971 | Podell . | |
| 3,980,976 | 9/1976 | Tadama et al. | 333/24 C X |
| 4,054,850 | 10/1977 | Gerrish | 333/260 X |
| 4,139,827 | 2/1979 | Russell . | |
| 4,376,921 | 3/1983 | Dickens et al. | 333/116 |
| 4,459,568 | 7/1984 | Landt | 333/116 |
| 4,647,878 | 3/1987 | Landis et al. | 333/115 |
| 4,700,152 | 10/1987 | Wilson | 333/24 C |
| 4,737,740 | 4/1988 | Millican et al. | 333/116 |
| 4,754,241 | 6/1988 | Spinner | 333/111 |
| 4,988,963 | 1/1991 | Shirosaka et al. | 333/261 |

*Primary Examiner*—Paul Gensler

*Attorney, Agent, or Firm*—W. G. Sutcliff

[57] ABSTRACT

A radio frequency coupler connector includes a housing having first and second housing portions. The first housing portion includes a first open-ended launcher operatively connected to a first connection terminal, and the second housing portion includes a second open-ended launcher operatively connected to a second connection terminal. When the first and second housing portions are assembled, the first and second open-ended launchers are overlapped and separated by a dielectric, thereby providing a non-contact connection by capacitive coupling.

21 Claims, 7 Drawing Sheets

FIG. 7
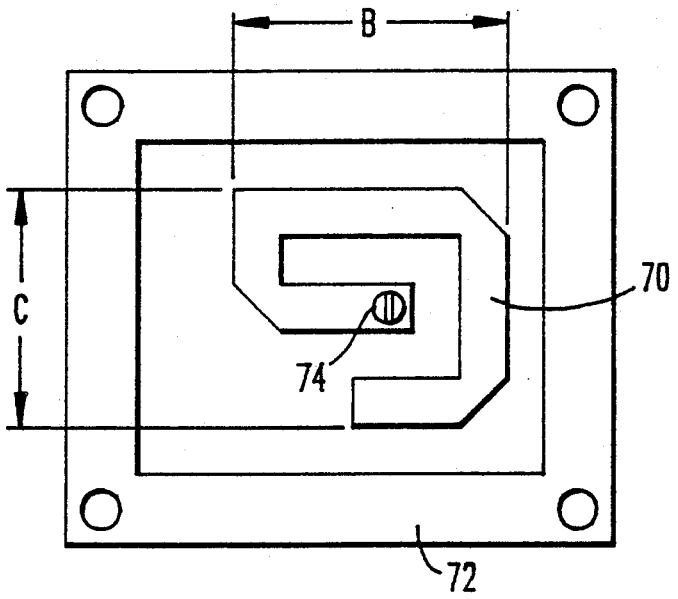
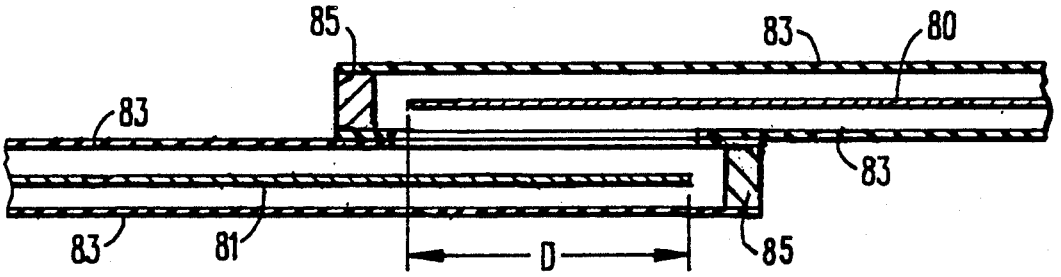
FIG. 8

FIG. 12A
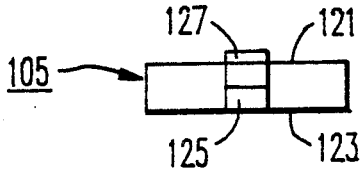
FIG. 12B
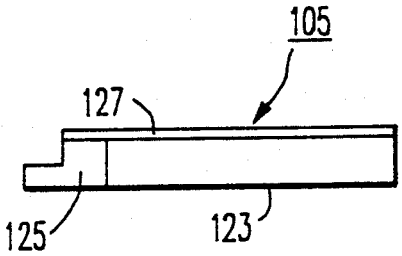
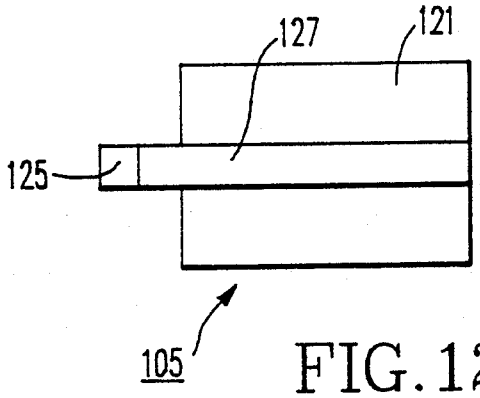
FIG. 12C
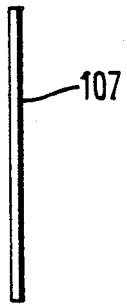
FIG. 13A
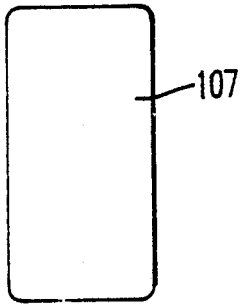
FIG. 13B

NON-CONTACTING RADIO FREQUENCY COUPLER CONNECTOR

BACKGROUND OF THE INVENTION

1. Field of the Invention

The present invention relates generally to a radio frequency connector and, more specifically, to a non-contacting radio frequency connector that employs capacitive coupling.

2. Description of the Related Art

Traditionally, coaxial connectors and waveguide connectors have been used for connecting radio frequency circuits. Coaxial cables include an inner conductor and an outer conductor shield separated by a dielectric. Coaxial connectors usually have slip spring fingers for contacting the inner conductor of a coaxial cable. After a period of time and repeated connections, the slip spring fingers and the inner conductors corrode and platings thereon wear off. Also, after repeated connections, the inner conductor tends to bend out of contact with the slip spring fingers. Each of these effects can result in a non-connection, a high voltage standing-wave ratio (VSWR), and arcing.

Waveguide connectors usually bolt together at their flanges, and generally require an inside width of at least $\lambda/2$ in order to transmit a signal (where $\lambda$ is the wavelength of the signal to be transmitted). Also, a waveguide connector requires a balun, i.e., a network for the transition from an unbalanced transmission line to a balanced transmission line, having a transition length of $\lambda/4$. Consequently, a waveguide connector is relatively large. Though a waveguide connector can be made smaller with dielectric loading, dielectric loading results in increased insertion loss.

Connection to a microstrip lead of a radio frequency microstrip circuit, e.g., a transmitter/receiver module, may be made by transition to a stripline, a coaxial connector or a microstrip wire bonded to another microstrip radio frequency circuit. Connection to a stripline lead of such a radio frequency microstrip circuit may be made by press mating with another stripline. Each of these connections is bulky and inherently involves contact complexity. Also, each of these connections, except for the coaxial connector, requires connection in a plane parallel to the plane of the substrate of the radio frequency microstrip circuit. Only the coaxial connector permits connection at any angle with respect to the plane of the substrate of the radio frequency microstrip circuit. However, coaxial connectors are bulky and their performance deteriorates over time and after repeated connections.

Consequently, there is a need for a radio frequency connector that may be made small without increasing insertion loss; that is not subject to an increased VSWR, arcing and non-connection over time and after repeated connections; and that permits connection at any angle relative to an input or output lead.

SUMMARY OF THE INVENTION

An object of the present invention is to provide a radio frequency connector that is broad band and phase repeatable, and which is not subject to an increased VSWR, arcing, and non-connection over time and after repeated connections.

Another object of the present invention is to provide a radio frequency connector having a relatively small size and low insertion loss.

Yet another object of the present invention is to provide a radio frequency connector that permits simultaneous connection of plural radio frequency circuits.

Still another object of the present invention is to provide a radio frequency connector which allows hermetically-sealed and blind mating connections.

A further object of the present invention is to provide a radio frequency connector which allows connection to be made at any angle with respect to the plane of a substrate of a radio frequency microstrip circuit.

These and other objects of the present invention are met by providing a first connection terminal operatively connected to a first open-ended launcher, a second connection terminal operatively connected to a second open-ended launcher, a portion of each of the first and the second open-ended launchers being overlapped and having a dielectric therebetween, and a disconnectable housing enclosing the first and second open-ended launchers and the dielectric. The disconnectable housing includes first and second housing portions. The first connection terminal and the first open-ended launcher are associated with the first housing portion, while the second connection terminal and the second open-ended launcher are associated with the second housing portion. The dielectric is associated with at least one of the first and second housing portions.

In another aspect of the invention, the first and second housing portions may be mounted flush one against the other, and may include a hermetic-sealing gasket therebetween. Furthermore, the first and second housing portions may respectively include a tapered pin and receiving hole.

In yet another aspect of the present invention, the first and second housing portions may respectively include plural first and second open-ended launchers.

In a further aspect of the present invention, at least one of the first and the second open-ended launchers includes a first metal conductor strip formed upon a ceramic block. The first metal conductor strip is operatively connected to a second metal conductor strip formed on a dielectric block.

These and other features and advantages of the present invention will become more apparent with reference to the following detailed description and drawings. Like numerals refer to like elements throughout.

BRIEF DESCRIPTION OF THE DRAWINGS

FIG. 7 is a top view of the mounting surface of a connector according to a second embodiment of the present invention;

FIG. 8 is a sectional side view of a connector according to a third embodiment of the present invention;

FIGS. 12A, 12B and 12C are front, side and top views, respectively, of a dielectric block according to the fifth embodiment of the present invention;

FIGS. 13A and 13B are side and front views, respectively, of a dielectric plate according to the fifth embodiment of the present invention.

DETAILED DESCRIPTION OF THE PREFERRED EMBODIMENT

Figure 1:
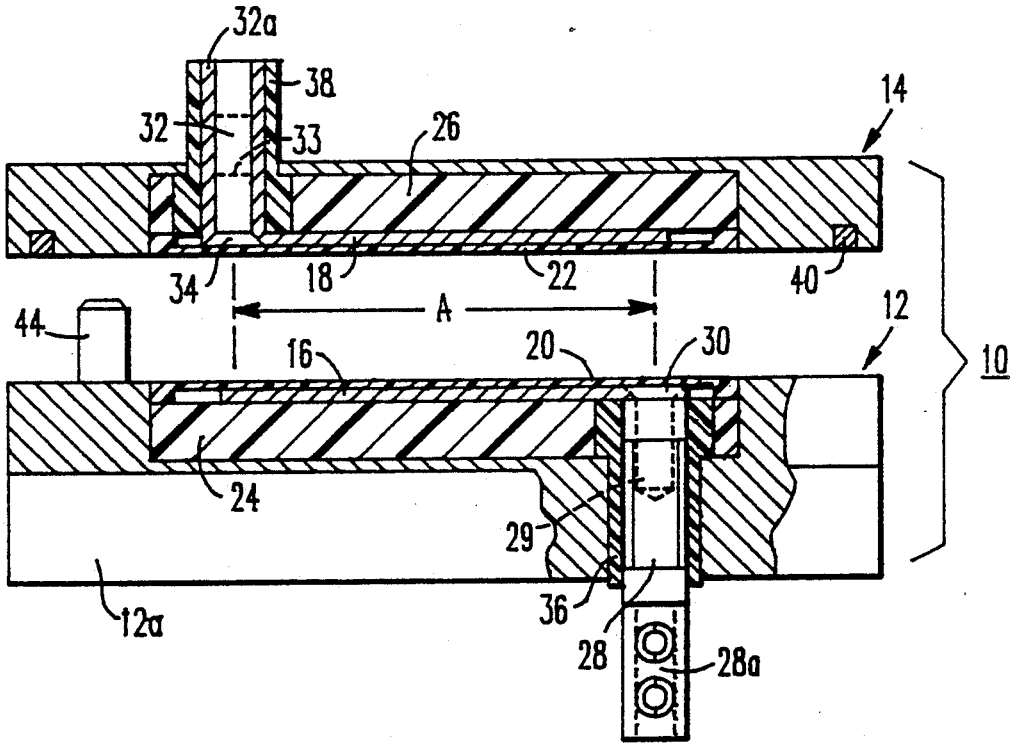
FIG. 1 is a disconnected cross-sectional view of a connector according to a first embodiment of the present invention.

Referring now to FIG. 1, the radio frequency (about 10 kilohertz to 100 gigahertz) coupler connector is generally referred to by numeral 10. Radio frequency coupler connector 10 includes a housing portion 12, which flushmates with a housing portion 14. Housing portion 12 contains an open-ended launcher 16, and housing portion 14 contains an open-ended launcher 18.

Open-ended launchers 16, 18 oppose each other and are separated by dielectric skins 20, 22. Open-ended launcher 16 is located between dielectric skin 20 and a dielectric plate 24. Open-ended launcher 18 is located between dielectric skin 22 and a dielectric plate 26. A pin connector 28 includes a tapped hole 29, into which a screw 30 is inserted to secure open-ended launcher 16 to pin connector 28. A pin connector 32 includes a tapped hole 33, into which a screw 34 is inserted to secure open-ended launcher 18 to pin connector 32. Pin connector 28 is housed within a flanged sleeve 36, and pin connector 32 is housed within a flanged sleeve 38.

Housing portions 12, 14, open-ended launchers 16, 18, pin connectors 28, 32 and screws 30, 34 are made of and/or plated with conductive material, e.g., brass and aluminum. Open-ended launcher 16 and pin connector 28 are electrically isolated from housing portion 12 by dielectric plate 24 and flanged sleeve 36. Also, open-ended launcher 18 and pin connector 32 are electrically isolated from housing portion 14 by dielectric plate 26 and flanged sleeve 38. Sleeves 36,38 are made of a dielectric material, e.g., Teflon®. Dielectric skin 20 and dielectric plate 24 may be made from any dielectric, e.g. Stycast® (cross-linked polystyrene having a dielectric constant between 2.1 and 2.5) produced by Emerson and Cummings Co.

Open-ended launcher 16 is electrically connected to an input or output, e.g., a stripline, through pin connector 28. A stripline generally includes a flat center conductor which is separated from flat outer conductors by a dielectric, e.g., air. Pin connector 28 includes an input or output connection portion 28*a*, which is adapted for connection with the center conductor of a stripline input or output, with the center conductor of the stripline extending perpendicular to open-ended launcher 16. However, pin connector 28 may be adapted to be connected to a stripline extending in any other direction or to any other radio frequency conducting means, e.g., coaxial cable, waveguide, or the like.

Similarly, open-ended launcher 18 is electrically connected to an input or output through pin connector 32. Pin connector 32 includes an input or output connection portion 32*a*, which is adapted to be connected to the center conductor of a stripline input or output, with the center conductor of the stripline extending parallel to the open-ended launcher 18. As with pin connector 28, pin connector 32 may be adapted to be connected to a stripline extending in any other direction or connected to any other radio frequency conducting means.

Electrically, housing portions 12, 14 and open-ended launchers 16, 18 act as a "split" stripline. That is, housing portions 12, 14 act as the outer conductors of a stripline; while open-ended launchers 16, 18, because of their locations and length of overlap, are capacitively coupled and act as the center conductor of a stripline.

Open-ended launchers 16, 18 have a length of overlap A, which is preferably $\lambda/4$ (where $\lambda$ is equal to the wavelength of the signal to be input/output). Good connection is made by simply connecting, e.g., bolting, the housing portions 12, 14 together. Open-ended launchers 16, 18 are capacitively coupled because of their locations and length of overlap. Direct electrical contact between open-ended launchers 16, 18 is not used, thus providing advantages, e.g., a consistently low VSWR over time and with repeated connections, over conventional connectors. Though preferably $\lambda/4$, the length of overlap A of launchers 16, 18 may be more or less than $\lambda/4$. The input or output to respective open-ended launchers 16, 18 must be at opposite sides of their overlap.

Figure 2:
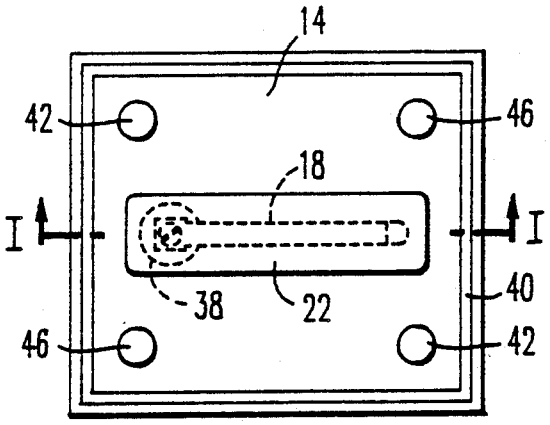
FIG. 2 is a top view of the mounting surface of a first housing portion of the connector in FIG. 1.

As shown in FIGS. 1 and 2, housing portion 14 may include a gasket 40, which hermetically seals housing portions 12, 14 when they are secured together.

Figure 3:
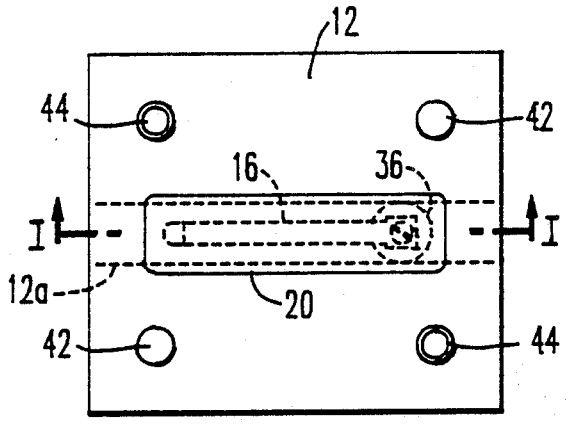
FIG. 3 is a top view of the mounting surface of a second housing portion of the connector in FIG. 1.

Referring to FIGS. 2 and 3, housing portions 12,14 may be secured together by, for example, bolts placed through holes 42. In addition, to aid in blind mating connections and alignment, housing portions 12, 14 may respectively include tapered pins 44 and receiving holes 46. Blind mating connections are connections that must be accomplished with a limited view or no view.

Figure 4:
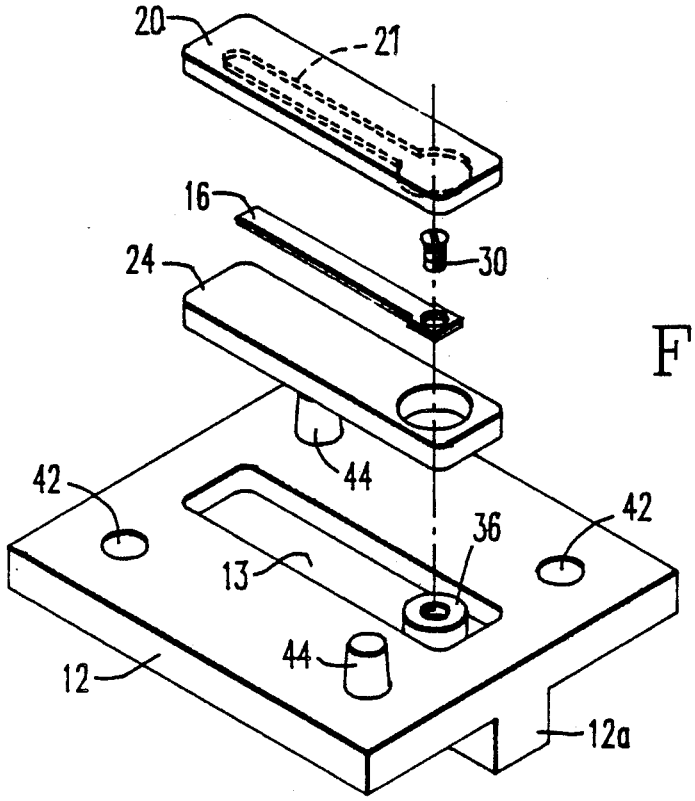
FIG. 4 is an exploded view of the housing portion of FIG. 3.

As shown in FIG. 4, housing portion 12 includes recess 13, into which dielectric plate 24 is placed. Then, open-ended launcher 16 is attached to pin connector 28 by screw 30. Dielectric skin 20 includes a groove 21, into which open-ended launcher 16 is received. Dielectric skin 20 is then secured, e.g., glued, over dielectric plate 24. However, groove 21 may be omitted or included in either or both dielectric skin 20 and dielectric plate 24.

As best seen in FIG. 4, housing portion 12 may include lip portion 12*a* if pin connector 28 is to be connected to a flat center conductor of a stripline input or output that extends perpendicular to open-ended launcher 16. The stripline has a pair of flat outer conductors that surround the flat center conductor, each flat outer conductor is attached to lip 12*a*, e.g., one flat outer conductor is attached to each side of lip 12*a*.

Because open-ended launchers 16, 18 do not contact each other, the present invention eliminates the problems associated with the inner conductors of prior art coaxial conductors, e.g. non-connection, high VSWR, and arcing due to time and repeated connections. Also, the present invention has a mating area which is less than one-half than that of prior art waveguide connectors. Prior art waveguide connectors require an inner width of at least $\lambda/2$, if not dielectrically loaded. In contrast, the present invention may have a length of overlap A of less than λ/4. The present invention also has a shorter length than prior art waveguide connectors which require a balun having a length of at least λ/4 for transition from stripline to waveguide. The present invention does not require a balun transition, and therefore has a shorter length. Although waveguide connectors may be made smaller with dielectric loading, increased insertion loss is a consequence thereof.

As shown in FIGS. 1–4, open-ended launchers 16, 18 are substantially planar. However, open-ended launchers 16, 18 need not be planar, e.g., they may be cylindrical like a rod. Also, the area of overlap of open-ended launchers 16,18 may be in any geometric configuration, thereby further reducing the mating or coupling area of the present invention.

Figure 5:
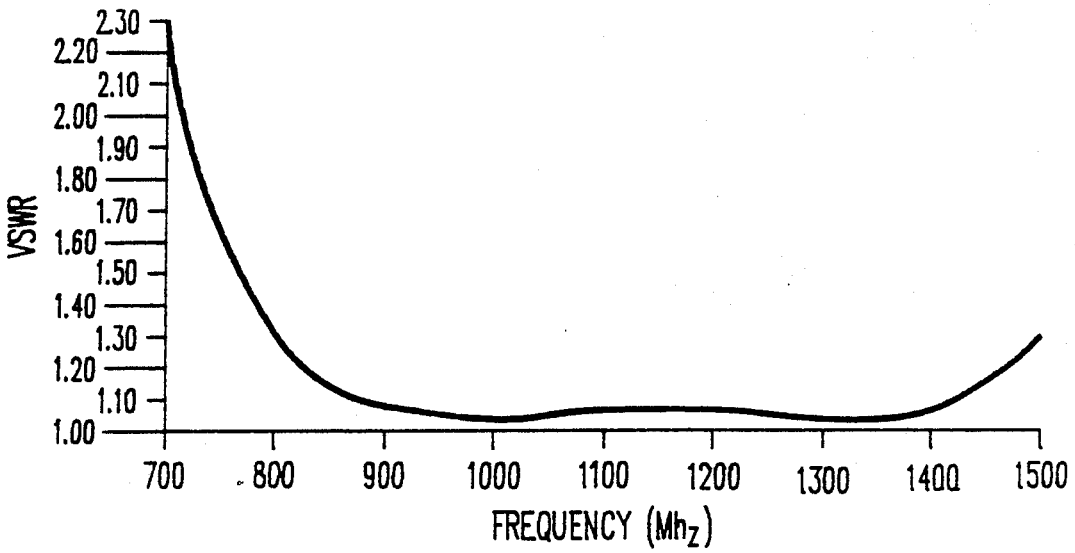
FIGS. 5 and 6 are graphs, respectively, showing the voltage standing-wave ratio and insertion loss over a selected frequency range for the connector shown in FIG. 1.
Figure 6:
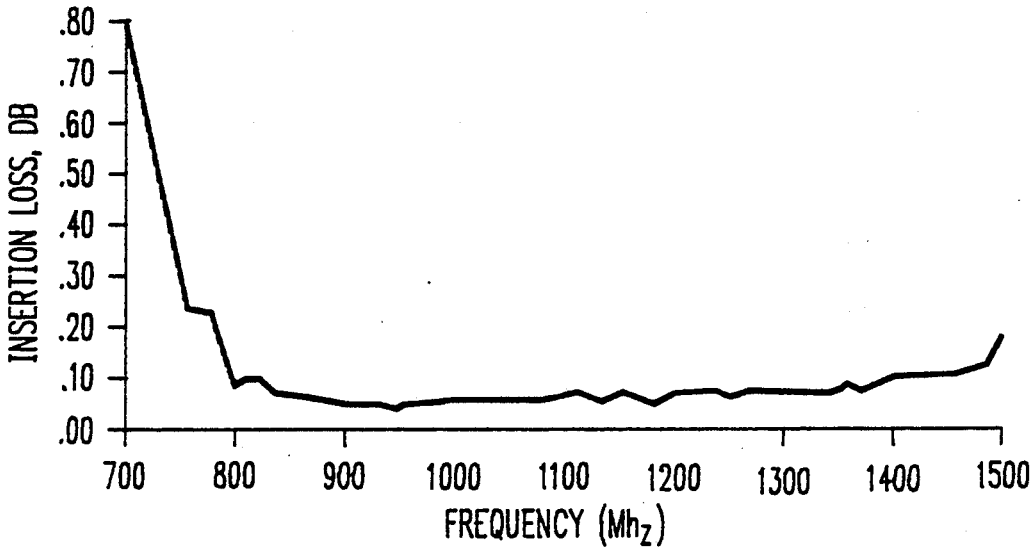

FIGS. 5 and 6 are graphs that respectively show VSWR and insertion loss measurements obtained from a bread board example of radio frequency coupler connector 10. Low VSWR and low insertion loss were obtained between 800 megahertz and 1500 megahertz. Similar low VSWR and low insertion loss may be obtained in other radio frequency ranges by changing the dimensions of the various elements of radio frequency coupler connector 10, e.g., the length of overlap between the open-ended launchers 16,18.

In the bread board example, open-ended launchers 16, 18, each had a length of 1.917 inches (4.869 cm), a width of 0.165 inches (0.419 cm) along its major portion and a thickness of 0.063 inches (0.16 cm). Dielectric skins 18, 20, each had an overall thickness of 0.095 inches (0.24 cm), with groove 21 having a depth of 0.063 inches (0.16 cm). The combined thickness of dielectric skins 20, 22 is not critical, although as the combined thickness of dielectric skins 20, 22 increases, the width of the open-ended launchers 16, 18 must also increase.

Dielectric plates 24, 26 each had a thickness of 0.218 inches (0.554 cm). Housing portions 12,14 each had a width of 3.000 inches (7.620 cm) and a height of 3.500 inches (8.890 cm) on their mating surfaces and a thickness of 0.376 inches (0.955 cm). Housing portion 12 also included a lip 12A protruding 0.500 inches (1.27 cm) and having a width of 0.500 inches (1.27 cm). Recess 13 had a width of 0.670 inches (1.70 cm), a height of 2.500 inches (6.35 cm) and a depth of 0.313 inches (0.795 cm).

In a second embodiment of the present invention shown in FIG. 7, an open-ended launcher 70 is formed such that dimensions B and C are each less than λ/12. The substantially G-shaped geometric configuration of open-ended launcher 70 further reduces the mating area of the present invention. Open-ended launcher 70 is included within housing portion 72, which mates with another housing portion (not shown) that includes a corresponding open-ended launcher (not shown). Similar to the overlap between open-ended launchers 16,18 in the second embodiment of the present invention, open-ended launcher 70 and the corresponding open-ended launcher overlap when housing portion 72 and the other housing portion are mated. The input to open-ended launcher 70 and the output to the corresponding open-ended launcher are respectively connected to pin connectors at opposite ends of the overlap. For example, open-ended launcher 70 may be operatively connected to a pin connector by a screw 74, while the corresponding open-ended launcher may be operatively connected to a pin connector at the opposite end of the overlap. The housing portion 72 may include bolt holes and/or tapered pins/receiving holes similar to those discussed relative to the first embodiment of the invention.

The open-ended launcher/screw/pin connector construction shown in FIGS. 1–4 and 7 is a preferred embodiment, but is not exclusive. For example, in a third embodiment of the present invention shown in FIG. 8, an inner conductor 80 is overlapped with an inner conductor 81. The length of overlap D is preferably λ/4. Inner conductors 80,81 are each sandwiched between a pair of flat outer conductors 83. Two flat outer conductors 83 are assembled into contacting relationship by, for example, bolting. These two contacting flat outer conductors 83 each have cut-out areas at the location corresponding to the overlap of inner conductors 80,81. Inner conductors 80, 81 respectively form open-ended launchers in the area of overlap. The area between flat outer conductors 83 and inner conductor 80,81 includes a dielectric, e.g., air. Flat outer conductors 83 may be supported by conductive supports 85. Inner conductors may be supported by dielectric supports (not shown).

Figure 9:
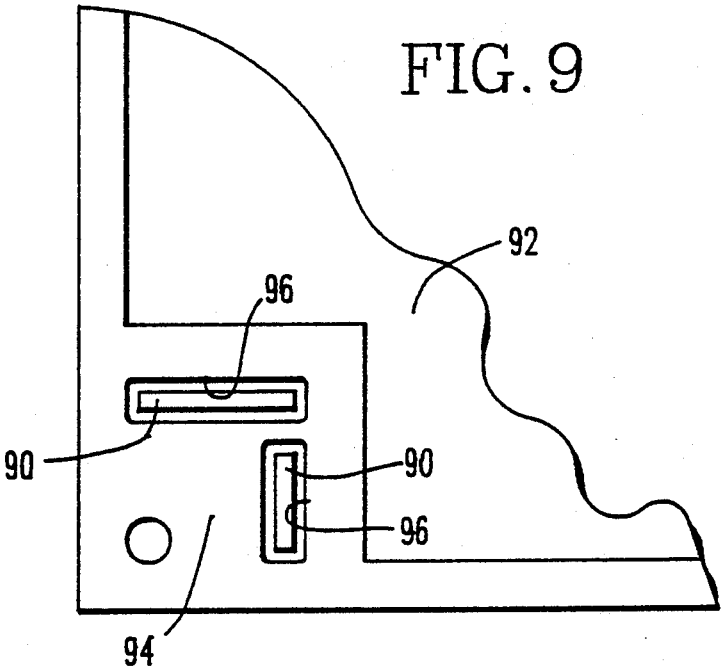
FIG. 9 is a top view of a mounting surface of a connector according to a fourth embodiment of the present invention.

As shown in FIG. 9, a fourth embodiment of the present invention includes a plurality of open-ended launchers 90 in a housing 92, which may also contain other electrical or mechanical components. A radio frequency connector portion 94 may comprise only a small part of housing 92. Open-ended launchers 90 are included within recesses 96 of radio frequency connector portion 94. Housing 92 is mated with a corresponding housing (not shown) having a radio frequency connector portion (not shown) and open-ended launchers (not shown) corresponding to radio frequency connector portion 94 and open-ended launchers 90. As with the previously discussed embodiments, housing 92 may be mated with the corresponding housing by, for example, bolting and/or tapered pins/receiving holes.

Figure 10:
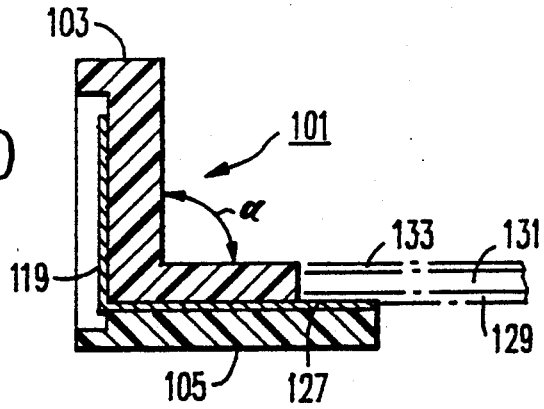
FIG. 10 is an assembled side cross-sectional view of a housing portion of a connector according to a fifth embodiment of the present invention.

FIG. 10 is an assembled side view of a housing portion 101 of a fifth embodiment of the present invention. This embodiment may be utilized, for example, in X band connection (about 5200 to 10,900 megahertz). Housing portion 101 includes an L-shaped part 103, a planar part 105 and a dielectric plate 107 (see FIG. 11A).

Figure 11A:
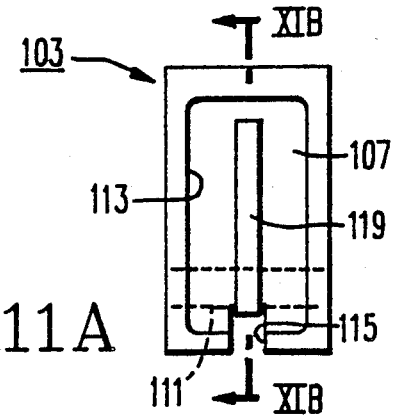
FIGS. 11A and 11B are front and side cross-sectional views, respectively, of a ceramic block according to the fifth embodiment of the present invention.
Figure 11B:
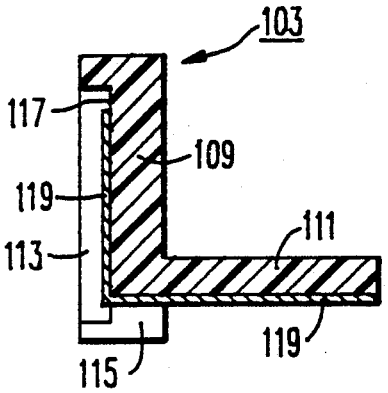

Referring to FIGS. 11A and 11B, L-shaped part 103 is made of a dielectric, e.g., selectively metalized ceramic having a dielectric constant of about 9.6. As shown in FIG. 11B, L-shaped part 103 includes a vertical portion 109 having a width of 0.115 inches (0.292 cm), length of 0.120 (0.305 cm) inches, and thickness of 0.020 inches (0.051 cm), and a horizontal portion 111. Vertical portion 109 and horizontal portion 111 need not be perpendicular to one another, i.e., vertical portion 109 and horizontal portion 111 may assume any desired angle α (as shown in FIG. 10) relative to one another. Vertical portion 109 includes a recess 113 and a notch 115. Recess 113 is oblong in a vertical direction (as shown in FIG. 11A) and includes a vertical face 117. Alternatively, recess 113 may extend in any other angle. A metal conductor strip 119 is formed on vertical face 117 from an upper area (as shown in FIG. 11A) of recess 113 down to notch 115 continuing along the lower side (as shown in FIG. 11B) of horizontal portion 111. Metal conductor strip 119 formed upon vertical face 117 acts as an open-ended launcher. Metal conductor strip 119 is, for example, vapor deposited aluminum having a width of 0.015 inches (0.038 cm).

As shown in 12A–12C, planar part 105 includes a top face 121, a bottom face 123, and a notched protrusion 125. Notched protrusion 125 fits within notch 115 of part 103 when L-shaped part 103 and planar part 105 are joined. A metal conductor strip 127 is formed on top face 121 at a position corresponding to metal conductor strip 119 on the lower side of horizontal portion 111 of part 103. Metal conductor strip 127 is, for example, vapor deposited and has a width of 0.015 inches (0.038 cm). Part 105 is made of a dielectric, e.g., a dielectric block having bottom face 123 fully metalized.

FIGS. 13A and 13B are side and front views, respectively, of dielectric plate 107. Dielectric plate 107 is accommodated within recess 113, and covers the portion of metal conductor strip 119 formed on vertical face 117 of L-shaped part 103.

L-shaped and planar parts 103, 105 are assembled and co-fired to form the housing portion 101. As best shown in FIG. 10, planar part 105 extends beyond the horizontal portion of L-shaped part 103, leaving a section of metal conductor strip 127 exposed. This exposed conductor 127 may provide a connection to a microstrip of a radio frequency microstrip circuit, e.g., a transmitter/-receiver module. As shown in phantom in FIG. 10, a microstrip generally includes a thin-film conductor strip 129 formed upon a flat dielectric substrate 131, and a thin-film ground plane 133 on the other side of the substrate.

Housing portion 101 is then fitted into the radio frequency microstrip circuit so that exposed metal conductor strip 127 is electrically connected thereto, and co-fired with the radio frequency microstrip circuit. Dielectric plate 107 is then installed in recess 113. Another housing portion (not shown) having a corresponding open-ended launcher (not shown) is secured, e.g., by clamping, to housing portion 101, thereby completing connection.

Figure 14A:
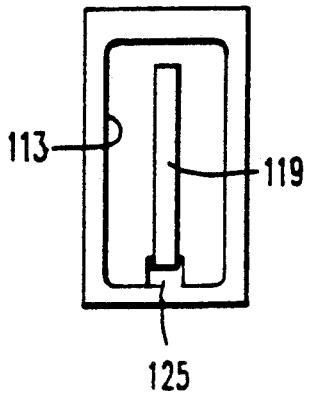
FIGS. 14A, 14B and 14C are examples of various skew angles according to the fifth embodiment of the present invention.
Figure 14B:
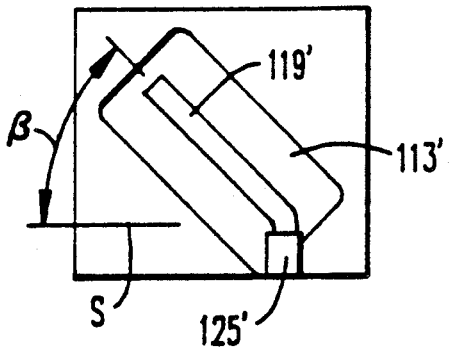
Figure 14C:
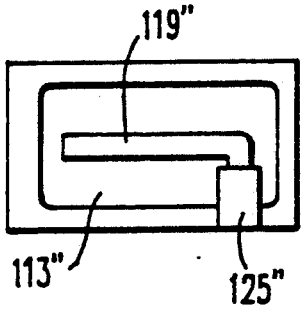

FIGS. 14A, 14B and 14C are examples of various skew angles according to the fifth embodiment of the present invention. Line S in FIG. 14B represents the plane of the substrate of the radio frequency microstrip circuit. In this plane metal conductor strip 127 electrically connects (as shown in phantom in FIG. 10) with the radio frequency microstrip circuit. Prior art connectors, with the exception of coaxial connectors, disadvantageously require mating to be accomplished in the plane of the substrate of the radio frequency microstrip circuit. The coaxial connector, on the other hand, is bulky and suffers from high VSWR and high insertion loss over time and with repeated connections.

However, as shown in FIGS. 14A–14C, connection according to the present invention may be skewed at any angle $\beta$ relative to the plane of the substrate of the radio frequency microstrip circuit. The orientation shown in FIG. 14A has an angle $\beta$ equal to 90°, while the angle $\beta$ in the orientation shown in FIG. 14C is equal to 0 degrees.

A radio frequency coupler connector according to the present invention is advantageous because it may be made small without increased insertion loss; is not subject to an increased VSWR, arcing and non-connection over time and with repeated connections; and permits connection to be skewed at any angle relative to the plane of the substrate of a radio frequency microstrip circuit or any other input or output lead.

Numerous modifications and adaptions of the present invention will be apparent to those skilled in the art. For example, housing portion 101 may include a plurality of metal conductor strips, thereby allowing simultaneous connection of a plurality of radio frequency microstrip circuits. Thus, it is intended by the following claims to cover all such modifications and adaptions which fall within the spirit and scope and the invention.

What is claimed is:

1. A radio frequency coupler connector having first and second connection terminals, comprising:

a housing having a first housing portion and a second housing portion connected to and fixed relative to said first housing portion, said first and second housing portions respectively including first and second substantially planar surfaces, said first and second housing portions being disconnectable from each other at said first and second substantially planar surfaces, and said first and second housing portions being respectively associated with the first and second connection terminals;

a first open-ended launcher operatively connected to the first connection terminal, said first open-ended launcher being associated with said first housing portion; and a second open-ended launcher operatively connected to the second connection terminal, said second open-ended launcher being associated with said second housing portion, said first and second open-ended launchers being spaced apart and disposed in an at least partially overlapping relationship so as to be capacitively coupled when said first and second housing portions are connected together.

2. A radio frequency coupler connector as recited in claim 1, wherein:

said housing is at least partially made of a conductor, and said housing substantially encloses and is electrically isolated from said first and second open-ended launchers.

3. A radio frequency coupler connector as recited in claim 1, wherein:

said first housing portion includes at least one tapered pin; and said second housing portion includes a mating receiving hole.

4. A radio frequency coupler connector as recited in claim 1, wherein:

at least one of said first and second housing portions includes a gasket.

5. A radio frequency coupler connector as recited in claim 1, wherein:

at least one of said first and second housing portions includes means for connecting said first and second housing portions together.

6. A radio frequency coupler connector as recited in claim 5, wherein:

said means for connecting includes bolt holes located in each of said first and second housing portions.

7. A radio frequency coupler connector as recited in claim 1, wherein:

at least one of the first and second connection terminals includes a stripline.

8. A radio frequency coupler connector as recited in claim 1, further comprising:

a first pin connector operatively connected between said first open-ended launcher and the first connection terminal;

a second pin connector operatively connected between said second open-ended launcher and the second connection terminal;

a first sleeve electrically isolating said first pin connector from said first housing portion; and a second sleeve electrically isolating said second pin connector from said second housing portion.

9. A radio frequency coupler connector as recited in claim 1, further comprising:

a dielectric between said first and second open-ended launchers.

10. A radio frequency coupler connector as recited in claim 1, wherein:

said first and second open-ended launchers are substantially planar.

11. A radio frequency coupler connector as recited in claim 1, wherein:

said first and second open-ended launchers are substantially G-shaped.

12. A radio frequency coupler connector as recited in claim 1, wherein:

said overlap of said first and second open-ended launchers has a length of about ¼ of the wavelength of a radio frequency signal input at the first or second connection terminal.

13. A radio frequency coupler connector as recited in claim 1, wherein:

at least one of said first and second housing portions includes a ceramic material; and at least one of said first and second open-ended launchers includes a metal conductor strip formed on said ceramic material.

14. A radio frequency coupler connector as recited in claim 1, wherein:

said first open-ended launcher includes a first end and a second end, said first end of said first open-ended launcher being open-ended, and said second end of said first open-ended launcher being operatively connected to said first connection terminal;

said second open-ended launcher includes a first end and a second end, said first end of said second open-ended launcher being open-ended, and said second end of said second open-ended launcher being operatively connected to the second connection terminal;

said first and second ends of said first open-ended launcher respectively oppose said second and first ends of said second open-ended launcher when said first and second housing portions are connected together.

15. A radio frequency coupler connector as recited in claim 1, wherein:

said first and second open-ended launchers are substantially planar and lie in a plane substantially parallel to said substantially planar surfaces of said first and second housing portions.

16. A radio frequency coupler connector having first and second connection terminals, comprising:

a housing having a first housing portion and a second housing portion connected to said first housing portion, said first and second housing portions being disconnectable from each other, and said first and second housing portions being respectively associated with the first and second connection terminals;

said first housing portion includes a first part and a second part, said first part including a first metal conductor strip, said second part including a second metal conductor strip, and said first and second metal conductor strips being operatively connected;

a first open-ended launcher operatively connected to the first connection terminal through the first and second metal conductor strips, said first open-ended launcher being formed from a portion of said second metal conductor strip and being associated with said first housing portion; and a second open-ended launcher operatively connected to the second connection terminal, said second open-ended launcher being associated with said second housing portion, said first and second open-ended launchers being spaced apart and disposed in an at least partially overlapping relationship so as to be capacitvely coupled when said first and second housing portions are connected together.

17. A radio frequency coupler connector having first and second connection terminals, comprising:

a housing having a first housing portion and a second housing portion connected to said first housing portion, said first and second housing portions being disconnectable from each other, and said first and second housing portions being respectively associated with the first and second connection terminals;

a first open-ended launcher operatively connected to the first connection terminal, said first open-ended launcher being associated with said first housing portion;

a second open-ended launcher operatively connected to the second connection terminal, said second open-ended launcher being associated with said second housing portion, said first and second open-ended launchers being spaced apart and disposed in an at least partially overlapping relationship so as to be capacitively coupled when said first and second housing portions are connected together; and a plurality of said first and second open-ended launchers respectively associated with said first and second housing portions.

18. A radio frequency coupler connector having first and second connection terminals, at least one of the first and second connection terminals being operatively connected to a lead of a microstrip circuit having a substrate plane, comprising:

a housing having a first housing portion and a second housing portion connected to and fixed relative to said first housing portion, said first and second housing portions being disconnectable from each other, and said first and second housing portions being respectively associated with the first and second connection terminals;

a first open-ended launcher operatively connected to the first connection terminal, said first open-ended launcher being associated with said first housing portion;

a second open-ended launcher operatively connected to the second connection terminal, said second open-ended launcher being associated with said second housing portion, said first and second open-ended launchers being disposed in an at least partially overlapping relationship when said first and second housing portions are connected together;

a dielectric between said first and second open-ended launchers; and said first and second open-ended launchers extend in a direction skewed relative to the substrate plane.

19. A radio frequency coupler connector as recited in claim 18, wherein:

at least one of said first and second housing portions includes a ceramic material; and at least one of said first and second open-ended launchers includes a metal conductor strip formed on said ceramic material.

20. A radio frequency coupler connector having first and second connection terminals, at least one of the first and second connection terminals being operatively connected to a lead of a microstrip circuit having a substrate plane, comprising:

a housing having a first housing portion and a second housing portion connected to said first housing portion, said first and second housing portions being disconnectable from each other, and said first and second housing portions being respectively associated with the first and second connection terminals;

said first housing portion includes a first part and a second part, said first part including a first metal conductor strip, said second part including a second metal conductor strip, and said first and second metal conductor strips being operatively connected;

a first open-ended launcher operatively connected to the first connection terminal through the first and second metal conductor strips, said first open-ended launcher being formed from a portion of said second metal conductor strip and being associated with said first housing portion;

a second open-ended launcher operatively connected to the second connection terminal, said second open-ended launcher being associated with said second housing portion, said first and second open-ended launchers being disposed in an at least partially overlapping relationship when said first and second housing portions are connected together;

a dielectric between said first and second open-ended launchers; and said first and second open-ended launchers extend in a direction skewed relative to the substrate plane.

21. A radio frequency coupler connector having an input and an output, comprising:

a housing made of a conductive material and having a first housing portion and a second housing portion electrically connected to and fixed relative to said first housing portion, said first and second housing portions respectively including first and second substantially planar surfaces respectively having first and second recesses, said first and second housing portions being electrically disconnectable from each other at said first and second substantially planar surfaces, and said first and second housing portions being respectively associated with the input and output;

a first open-ended launcher disposed in said first recess and being electrically connected to the input and electrically isolated from said first housing portion;

a second open-ended launcher disposed in said second recess and being electrically connected to the output and electrically isolated from said second housing portion, said first and second open-ended launchers being disposed in an at least partially overlapped relationship when said first and second housing portions are electrically connected together; and a dielectric between said first and second open-ended launchers.

* * * * *